US006976604B2

(12) United States Patent
Connors, Jr. et al.

(10) Patent No.: US 6,976,604 B2
(45) Date of Patent: Dec. 20, 2005

(54) RESTRICTING FLOW IN DRINKING CONTAINERS

(75) Inventors: James A. Connors, Jr., Upton, MA (US); David E. Medeiros, Plainville, MA (US); George S. Dys, Mapleville, RI (US)

(73) Assignee: The First Years Inc., Stoughton, MA (US)

( * ) Notice: Subject to any disclaimer, the term of this patent is extended or adjusted under 35 U.S.C. 154(b) by 510 days.

(21) Appl. No.: 09/971,499

(22) Filed: Oct. 5, 2001

(65) Prior Publication Data

US 2003/0066839 A1 Apr. 10, 2003

(51) Int. Cl.[7] ..... A47G 19/22
(52) U.S. Cl. ..... 220/713; 22/717; 45/388
(58) Field of Search ..... 220/713, 714, 220/717, 704, 705, 254.3, 703; 215/388, 215/11.4, 235; D7/510, 511, 534; 222/564, 222/565, 571, 579, 482, 420, 566, 478, 479, 222/477

(56) References Cited

U.S. PATENT DOCUMENTS

| | | | | |
|---|---|---|---|---|
| 2,623,368 | A | 12/1952 | Olsen | |
| 2,630,944 | A * | 3/1953 | Wheaton | 222/108 |
| 3,424,342 | A | 1/1969 | Scopp et al. | |
| 3,447,714 | A | 6/1969 | Elliot | |
| 3,448,888 | A | 6/1969 | Smith et al. | |
| 3,452,896 | A | 7/1969 | Elliot | |
| D215,413 | S | 9/1969 | Donovan | |
| D259,231 | S * | 5/1981 | Kozlow, Sr. | D7/40 |
| 4,303,170 | A | 12/1981 | Panicci | |
| 4,373,642 | A | 2/1983 | Wolters et al. | |
| 4,388,996 | A | 6/1983 | Panicci | |
| D272,595 | S | 2/1984 | Chase et al. | |
| D285,906 | S | 9/1986 | Tyler | |
| 4,756,440 | A | 7/1988 | Gartner | |
| 4,819,824 | A | 4/1989 | Longbottom et al. | |
| 4,850,496 | A | 7/1989 | Rudell et al. | |
| 4,899,902 | A | 2/1990 | DeMars | |
| D313,556 | S | 1/1991 | Smith | |
| 4,986,437 | A | 1/1991 | Farmer | |
| 5,035,320 | A | 7/1991 | Plone | |
| 5,050,759 | A | 9/1991 | Marble | |
| 5,147,066 | A | 9/1992 | Snider | |
| 5,169,026 | A | 12/1992 | Patterson | |
| 5,186,347 | A * | 2/1993 | Freeman et al. | 220/254.1 |
| D334,114 | S | 3/1993 | Narsutis | |
| D336,850 | S | 6/1993 | Guillin | |
| 5,253,781 | A | 10/1993 | Van Melle et al. | |
| 5,363,983 | A * | 11/1994 | Proshan | 220/717 |
| 5,366,109 | A * | 11/1994 | Proshan | 220/717 |
| 5,377,860 | A | 1/1995 | Littlejohn et al. | |
| 5,529,202 | A * | 6/1996 | Shamis | 220/301 |

(Continued)

FOREIGN PATENT DOCUMENTS

| | | |
|---|---|---|
| DE | 22909423 | 12/1999 |

(Continued)

OTHER PUBLICATIONS

International Search Report for International Application No. PCT/US/31875.

*Primary Examiner*—Lien M. Ngo
(74) *Attorney, Agent, or Firm*—Fish & Richardson P.C.

(57) ABSTRACT

A disposable child's drinking cup has a lid with a drinking spout defining multiple open holes sized to resist leakage in the absence of suction, such as by the development of surface tension at the holes, and to allow flow when suction is applied. The holes are formed during molding of the lid.

79 Claims, 6 Drawing Sheets

U.S. PATENT DOCUMENTS 5,538,156 A * 7/1996 Proshan ..... 220/717
5,540,350 A 7/1996 Lansky
5,624,051 A 4/1997 Ahern, Jr. et al.
D379,431 S 5/1997 Mangla
D388,325 S 12/1997 Tucker et al.
D390,109 S 2/1998 Tucker et al.
D397,906 S * 9/1998 Briggs et al. ..... D7/392.1
5,881,893 A 3/1999 Manganiello
5,893,472 A * 4/1999 Forrer ..... 215/11.4
5,988,425 A 11/1999 Yehl et al.
6,230,923 B1 * 5/2001 Hung ..... 220/703
6,523,712 B1 * 2/2003 McGushion ..... 220/713

FOREIGN PATENT DOCUMENTS

GB 2285621 7/1995
WO WO 97/17005 5/1997

* cited by examiner

RESTRICTING FLOW IN DRINKING CONTAINERS

TECHNICAL FIELD

This invention relates to restricting flow in drinking containers, and more particularly to restricting flow in spill-resistant drinking containers for children, such as those commonly known as "sippy cups."

BACKGROUND

Children's drinking cups are generally provided with removable lids, to help prevent large spills. Commonly, these lids have drinking spouts extending from their upper surface, that children place in their mouths to sip from the cups. Such cups are sometimes called "sippy cups." Some sippy cup spouts have open slots or holes through which the liquid in the cup flows when the cup is inverted. Such slots or holes are generally sized for an acceptably high flow rate, for ease of cleaning, and to enable the passage of small drink particulates such as pulp in orange juice. Many parents understandably prefer sippy cups with valves that close off any flow opening in the spout until suction is supplied by the child, instead of permanently open holes or slots. The design of such valves traditionally entails a trade-off between flow rate during drinking and leak rate when not in use. Also, many such valves can be difficult to properly clean. Some valves are removable and can be misplaced. Some sippy cup valves are in the form of a flexible membrane with a normally closed slit which opens sufficiently under pressure to enable acceptable flow.

SUMMARY

We have realized that a drinking spout, such as that of a sippy cup lid, can provide an acceptably high flow rate and an acceptably low leak rate when equipped with a plurality of normally open holes of a particularly small size.

Several aspects of the invention feature a drinking container that includes a main body defining an interior cavity accessible through an opening at an upper end of the main body, and a removable lid secured to the main body at its upper end to cover the opening and enclose, together with the main body, the interior cavity to hold a liquid.

According to one aspect of the invention, the lid has an extended drinking spout defining multiple unrestricted holes providing open hydraulic communication between exterior surfaces of the container and the interior cavity. The holes have a size selected to permit less than 3 drops of leakage of fresh water from the interior cavity through the holes over a 10 second interval under quasi-static conditions with the container inverted, a static head of 2.0 inches (51 millimeters) of fresh water at the inner ends of the holes, and no vacuum applied to the spout; and to dispense an aggregate of at least 1.3 gram of fresh water from the spout over a 10 second interval with a static vacuum of 0.27 Bar below atmospheric pressure applied at the outer ends of the holes and a static head of 2.0 inches (51 millimeters) of fresh water at the inner ends of the holes, with the container inverted.

In some embodiments, the holes are defined through a membrane having a nominal thickness of between about 0.010 and 0.040 inch (0.25 and 1.0 millimeter), preferably between about 0.015 and 0.030 inch (0.4 and 0.8 millimeter), at the holes.

Preferably, the membrane comprises a semi-rigid material, and more preferably consists of a semi-rigid material.

By "semi-rigid", we mean a material that is not rubber-like or elastomeric, that is not elastic or resilient in use, as opposed, for example, to materials typically employed to form baby bottle nipples and the like. Molded polypropylene is a presently preferred semi-rigid material.

The membrane is preferably dimensionally stable, and in some cases is generally planar and perpendicular to a longitudinal axis of each hole.

In some preferred embodiments, the membrane is recessed within the drinking spout, such as a distance of at least 0.25 inch (6.4 millimeters).

In some configurations, the membrane, is advantageously integrally and unitarily molded from a resin, preferably with a nominal molded thickness of less than about 0.035 inch (0.90 millimeter), more preferably with a nominal molded thickness of between about 0.020 and 0.026 inch (0.51 and 0.66 millimeter).

In some cases the lid forms an air-tight seal with the main body at the upper end of the main body. In some other cases, only a liquid-tight seal is provided.

In some embodiments, the lid has a main body portion defining a peripheral groove sized to receive an upper rim of the cup. The lid may also have a snap ridge extending into the groove, or below the groove, at an outer edge thereof and positioned to snap under a rim of the cup when the cup and lid are fully engaged. In some cases, the snap ridge is discontinuous about a periphery of the lid.

Preferably, the holes each have a major lateral extent, perpendicular to a flow path along the hole, of less than about 0.025 inch (0.64 millimeter). More preferably, the major lateral extent of the holes is less than about 0.020 inch (0.51 millimeter), and even more preferably less than about 0.014 inch (0.36 millimeter). By "major lateral extent", we mean a greatest dimension measured transverse to flow, at a hole cross-section of minimum flow area. For a straight, cylindrical hole, for example, this would be the diameter of the hole.

Some spouts define at least four such holes, with each hole having a diameter of less than about 0.012 inch (0.30 millimeter), and some spouts define at least eight such holes.

In some particularly preferred embodiments, the holes are defined by molded surfaces of the drinking spout.

Some embodiments have holes that are flared at their inner ends. Some holes are defined through a membrane having a nominal thickness and forming a protruding lip about each hole, such that the holes each have a length greater than the nominal thickness of the membrane. In some cases such a lip extends toward the interior cavity. In some other cases, the lip extends away from the interior cavity. The lip tapers to a distal edge in some instances.

In some preferred embodiments, and particularly advantageous for disposability, both the main body and the lid are each formed of molded resin of a nominal thickness of less than about 0.035 inch (0.89 millimeter), preferably less than about 0.025 inch (0.64 millimeter). For improved disposability, some drinking containers have an empty weight less than about 25 grams, preferably less than about 18 grams.

Some lids are formed of a resin containing polypropylene.

To enhance the development of surface tension at the holes, lid material defining the holes preferably has a natural state surface energy of less than about 35 dynes per centimeter.

According to another aspect of the invention, a drinking container has a main body defining an interior cavity accessible through an opening at an upper end of the main body, and a removable lid secured to the main body at its upper end to cover the opening and enclose, together with the main body, the interior cavity to hold a liquid. The lid has an extended drinking spout sized to be received within a human mouth and defining multiple unrestricted holes providing open hydraulic communication between exterior surfaces of the container and the interior cavity, for dispensing liquid disposed proximate inner ends of the holes in response to a vacuum applied at outer ends of the holes. The holes each have a major lateral extent, perpendicular to a flow path along the hole, of less than about 0.025 inch (0.64 millimeter), and together form an aggregate flow path through the spout of an area of at least 0.35 square millimeter.

The holes are preferably of a size selected to cause fresh water in the interior cavity to form a stable meniscus at the holes under a static pressure head of 2.0 inches (51 millimeters) of fresh water, with the container inverted and atmospheric pressure applied to the outer ends of the holes.

Preferably, the holes form an aggregate flow path through the spout of an area of at least 0.42 square millimeter, even more preferably an area of at least 0.50 square millimeter.

In some preferred embodiments, the holes are defined through a dimensionally stable, semi-rigid membrane having a nominal thickness of between about 0.010 and 0.040 inch (0.25 and 1.0 millimeter) at the holes. In some cases, the membrane is generally planar and perpendicular to a longitudinal axis of each hole, and recessed within the drinking spout.

The lid, including the membrane, is in some instances integrally and unitarily molded from a resin, such as polypropylene. Preferably, the lid has a nominal molded thickness of less than about 0.035 inch (0.90 millimeter).

In some embodiments, the lid forms an air-tight seal with the main body at the upper end of the main body.

Preferably, the major lateral extent of the holes is less than about 0.020 inch (0.51 millimeter), and more preferably less than about 0.014 inch (0.36 millimeter).

Some drinking spouts define at least four such holes, and some at least eight such holes.

The holes are preferably defined by molded surfaces of the drinking spout, such as surfaces formed as the lid is molded.

Various holes are configured as described above with respect to embodiments of the first aspect of the invention.

In some cases, both the main body and the lid are each formed of molded resin of a nominal thickness of less than about 0.035 inch (0.89 millimeter), and the two together have an empty weight less than about 25 grams.

Preferably, the lid material defining the holes has a natural state surface energy of less than about 35 dynes per centimeter.

According to yet another aspect of the invention, a lid is provided for a drinking container for children. The lid has a main body portion defining a peripheral groove sized to receive an upper rim of a cup to enclose a cavity for holding a liquid, and a drinking spout extending from the main body portion toward an outer side of the body portion. The spout defines multiple unrestricted holes providing open hydraulic communication between opposite sides of the lid, for dispensing liquid disposed proximate inner ends of the holes in response to a vacuum applied at outer ends of the holes. The holes each have a major lateral extent, perpendicular to a flow path along the hole, of less than about 0.025 inch (0.64 millimeter), and together form an aggregate flow path through the spout of an area of at least 0.35 square millimeter.

Preferably, the holes are of a size selected to cause fresh water at the inner ends of the holes to form a stable meniscus at the holes under a static pressure head of 2.0 inches (51 millimeters) of fresh water, with the lid inverted such that the spout extends downward and atmospheric pressure applied to the outer ends of the holes.

In some preferred embodiments, the holes are defined through a membrane having a nominal thickness of between about 0.010 and 0.040 inch (0.25 and 1.0 millimeter) at the holes.

As discussed above, the membrane preferably comprises a semi-rigid material.

In some cases, the holes are defined through a dimensionally stable membrane within the drinking spout, with the membrane preferably recessed at least 0.25 inch (6.5 millimeters) within the drinking spout, as measured from a distal end of the spout. In some instances, the membrane is generally planar and perpendicular to a longitudinal axis of each hole, and the lid, including the membrane, is integrally and unitarily molded from a resin such as polypropylene.

In some embodiments, the lid has a nominal molded thickness of less than about 0.035 inch (0.90 millimeter), preferably between about 0.020 and 0.026 inch (0.51 and 0.66 millimeter).

Some preferred lids have a solid surface across their extent, save for the drinking holes.

Preferably, the holes each have a major lateral extent, perpendicular to a flow path along the hole, of less than about 0.020 inch (0.51 millimeter), and more preferably less than about 0.014 inch (0.36 millimeter).

In some cases the drinking spout defines exactly three such holes, with each hole having a minimum diameter of between about 0.016 and 0.025 inch (0.41 and 0.64 millimeter). In some other cases, the drinking spout defines at least four such holes, with each hole having a diameter of less than about 0.020 inch (0.51 millimeter). In some configurations the drinking spout defines at least eight such holes.

Preferably, the holes are defined by molded surfaces of the drinking spout, and various holes are configured as described above with respect to embodiments of the first aspect of the invention.

In some embodiments the holes are of frusto-conical shape, with a larger end of each hole directed toward an inner side of the lid.

The lid, in some constructions, is formed of a resin containing polypropylene.

Preferably, the lid material defining the holes has a natural state surface energy of less than about 35 dynes per centimeter.

According to another aspect of the invention, a method of forming a lid for a drinking container is provided. The method includes injecting moldable resin into a closed die cavity defining a body cavity portion shaped to mold a body portion with a peripheral groove sized to receive an upper rim of a drinking container and, contiguous with the body cavity portion, a spout cavity portion shaped to mold a drinking spout sized to be received within a human mouth, with pins extending across the body cavity portion, the pins each having a diameter of less than about 0.025 inch (0.64 millimeter). The injected resin is solidified to form a lid shaped by the die cavity, the lid having a drinking spout with molded surfaces defining holes corresponding to the pins. The die cavity is opened, and the lid is removed from the cavity.

In some instances, the resin comprises polypropylene.

Preferably, the resin has a natural state surface energy of less than about 35 dynes per centimeter.

In some preferred embodiments, each pin has a diameter of less than about 0.020 inch (0.51 millimeter), for molding particularly small drinking holes.

In some cases, the die cavity has a series of at least three pins extending therethrough, for forming a corresponding number of holes in the lid.

In some embodiments, the die cavity is unobstructed across its extent in all directions, save for the pins.

According to yet another aspect, a method of preventing spills from drinking containers for children is provided. The method includes filling a cup with a consumable liquid, and securing a lid as described above across an upper end of the cup.

Without intending to be limiting, we theorize that such small holes each sufficiently resist leakage because they are small enough to enable a meniscus of fluid to develop across the holes that holds back the static weight of the liquid in the cup due to surface tension in the meniscus until suction is applied to the spout. Once suction is applied by a drinking child, the surface tension is overcome and the liquid flows more readily through the hole. The number of holes is chosen to provide sufficient total flow rate for drinking.

Such small drinking holes may limit the utility of such sippy cup lids with respect to particularly viscous drinks or juices with significant pulp content. However, these small holes can be particularly inexpensive to produce, and can even be formed during lid molding without secondary operations. Provided through a particularly thin, semi-rigid wall of the spout, for example, these small holes can be readily cleaned by automatic dishwashing methods. Alternatively, lids with such holes can be produced with such economy as to make the lid practically disposable, as a single use item, eliminating the need for cleanability.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
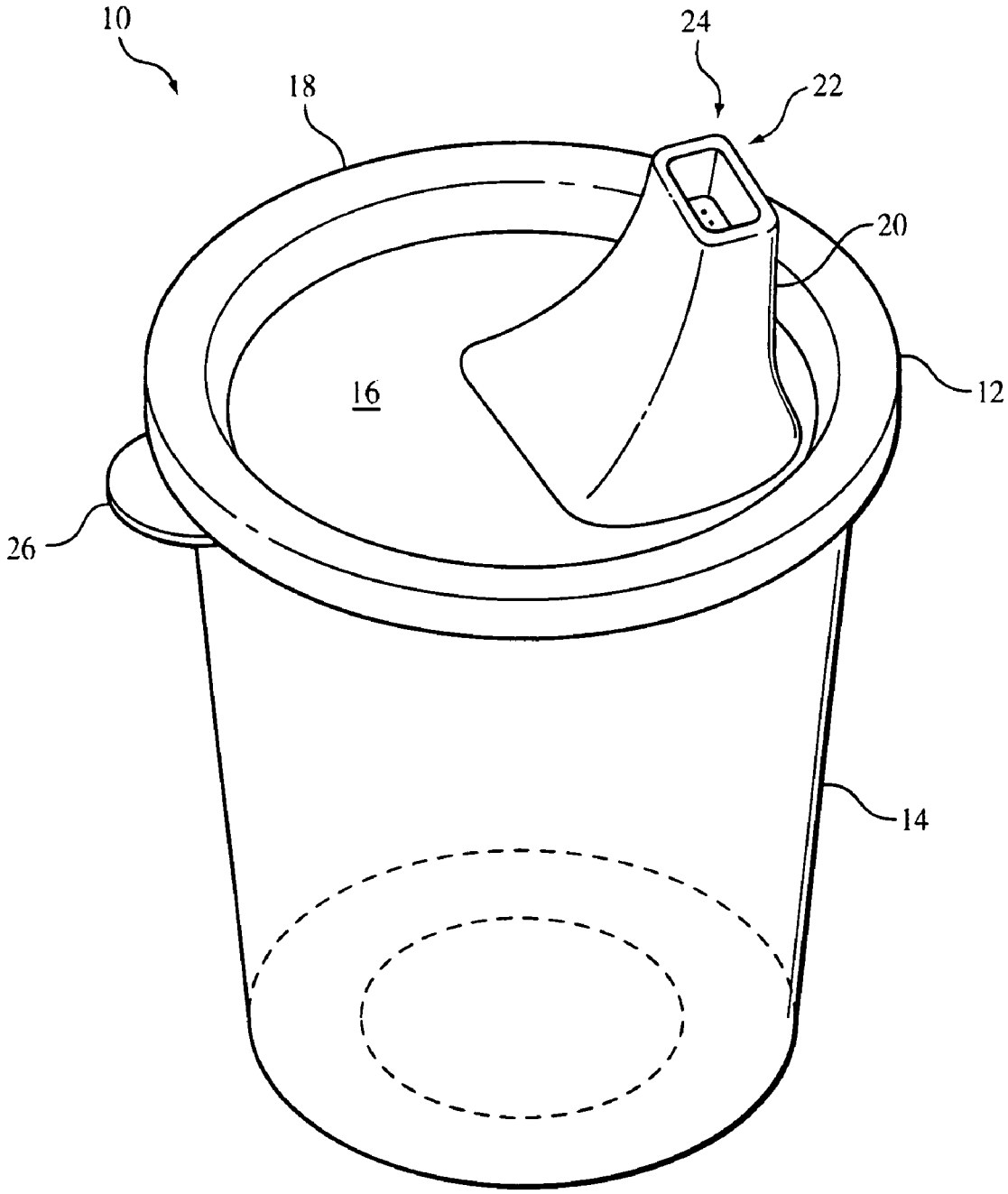
FIG. 1 is a perspective view of a disposable sippy cup.

Referring first to FIG. 1, cup 10 consists essentially of a lid 12 and a cup body 14, each molded of a polypropylene to have a nominal wall thickness of between about 0.020 and 0.026 inch (about 0.5 millimeter). Lid 12 has a generally planar upper surface 16 about the perimeter of which a circular ridge 18 extends upward to form a groove on the underside of the lid to receive an upper rim of the cup body 14. A drinking spout 20, integrally molded with the rest of the lid, extends upward from surface 16 to a distal end 22 shaped and sized to be comfortably received in a child's mouth for drinking. The upper end of the spout defines a blind recess 24 with a lower surface defining a series of drinking holes discussed in more detail below. Besides the drinking holes in the spout recess, the rest of lid 12 forms an air-tight seal at the top of cup body 14. A tab 26 extends laterally from an edge of the lid opposite spout 20, for prying the lid off of the cup body.

Figure 2:
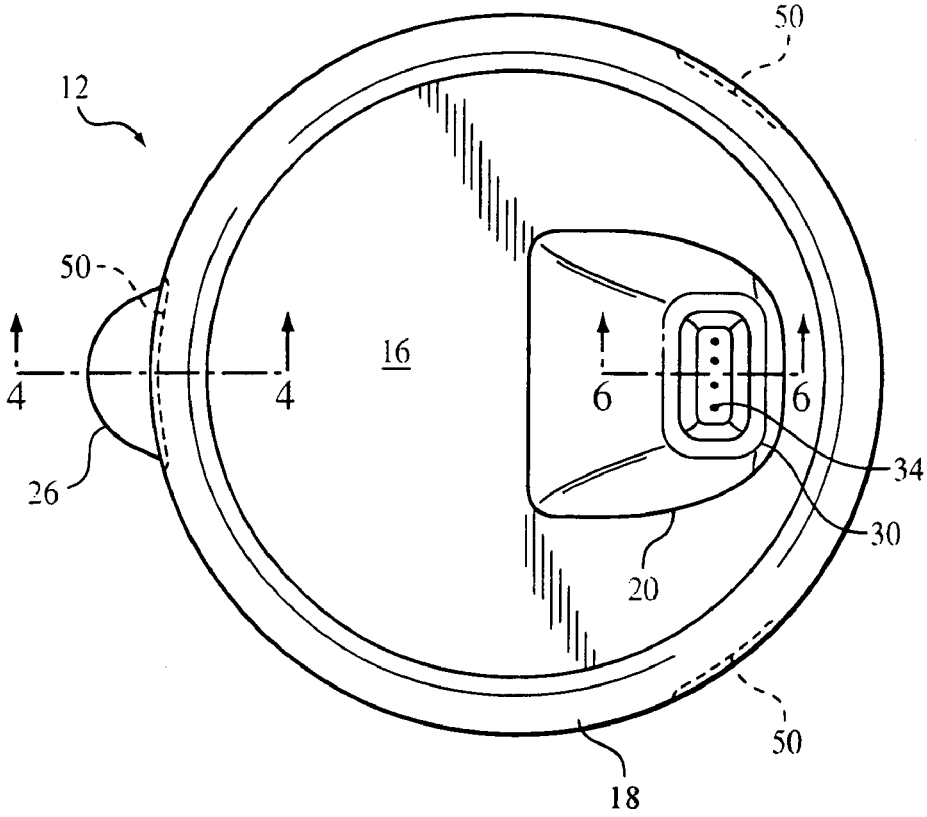
FIG. 2 is a top view of the lid of the sippy cup.
Figure 3:
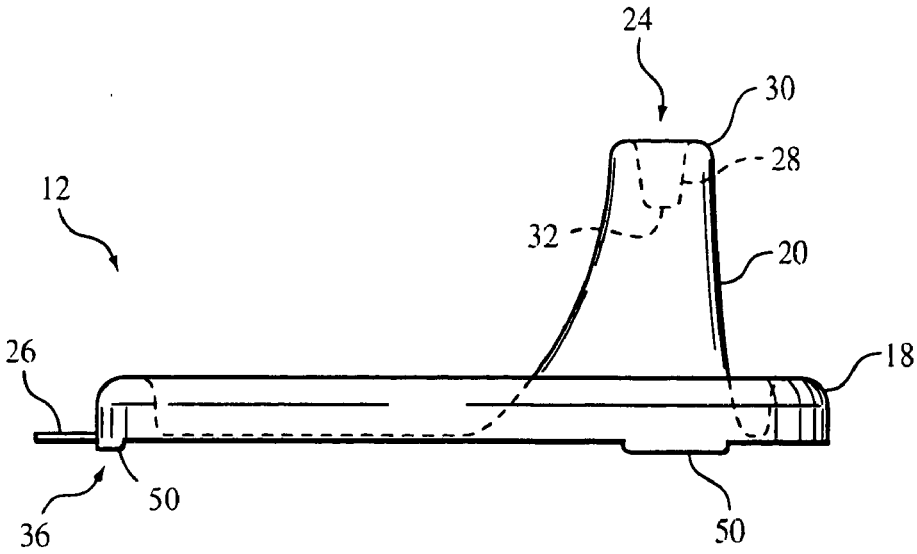
FIG. 3 is a side view of the cup lid.

FIGS. 2 and 3 further illustrate features of lid 12, such that the vertical walls 28 bounding recess 24 taper slightly toward each other from an upper rim 30 to a lower recess floor 32. A series of open, fixed holes 34 are molded through floor 32 to form a means of hydraulic communication through the spout. In this illustrated embodiment, four holes 34 are shown. Other embodiments have two, three, or more than four holes 34, as shown in later figures. FIG. 3 shows the circular perimeter groove 36 formed within ridge 18 on the underside of the lid.

Figure 4:
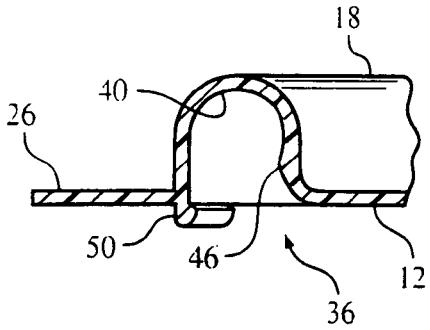
FIG. 4 is a cross-sectional view, taken along line 4—4 in FIG. 2.
Figure 5:
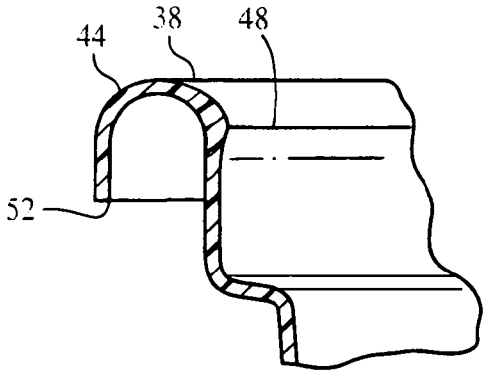
FIG. 5 is a radial cross-sectional view taken through the cup rim.

As shown in the enlarged views of FIGS. 4 and 5, the inner contour of groove 36 and outer contour of cup body rim 38 are selected to provide a slight snap fit of the lid onto the cup body, to provide a secure seal. The upper, inner surface 40 of ridge 18 of the lid and the upper, outer surface 44 of rim 38 of the cup body define semi-circular arcs of similar radii. These surfaces blend into tangential, vertical walls on the outboard side of the ridge and rim, but interlocking features are provided on the inboard side for an interference fit. On the lid (FIG. 4) this includes an outwardly projecting lip 46 that protrudes about 0.008 inch (0.2 millimeter) laterally into groove 36 from a vertical tangent to the inner edge of the upper, inner surface 40 of the groove. Similarly, on the cup body (FIG. 5), an inwardly projecting lip 48 protrudes about 0.008 inch (0.2 millimeter) toward the centerline of the cup body from a vertical tangent to the inner edge of the upper, outer surface 44 of the ridge. Thus, lips 46 and 48 produce a nominal maximum radial interference between rim 38 and groove 36 of about 0.016 inch (0.4 millimeter) as the two pieces are engaged.

To further help to maintain the engagement of cup body and lid, in this particular embodiment groove 36 has three snap ridges 50 extending downwardly and inwardly at the outer edge of the groove and positioned to snap below the lower, distal edge 52 of cup rim 38 when the cup and lid are fully engaged. A portion of one snap ridge 50 is visible in FIG. 4. The other snap ridges 50 are located at about 120 degree spacing about the lid perimeter, as shown in FIG. 2. Bending tab 26 upward helps to disengage the adjacent snap ridge 50 to remove the lid from the cup body.

Figure 6:
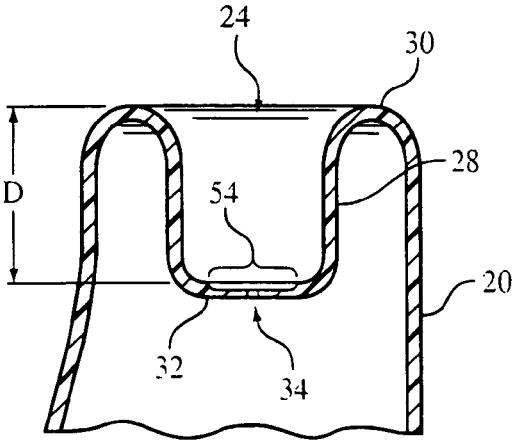
FIG. 6 is a cross-sectional view of the spout, taken along line 6—6 in FIG. 2.

Referring now to FIG. 6, recess floor 32 has a membrane portion 54 of a slightly lower thickness than the rest of spout 20. It is through this membrane portion 54 that holes 34 extend. In this illustrated embodiment, semi-rigid spout wall 54 has a tightly controlled thickness of 0.029 inch. The structure of the upper portion of spout 20 is such that membrane 54 maintains its generally planer, as-molded form during normal use, even with significant pressure applied to the outer surfaces of the spout. Furthermore, placing membrane 54 at the bottom of recess 24, a distance "D" of at least 0.25 inch (6.5 millimeters), protects holes 34 from damage or any unintentionally sharp edges about the holes from contacting a child's lips.

Various configurations of holes 34, as illustrated by example in FIGS. 7 through 11, provide different advantages for different applications.

Figure 7:
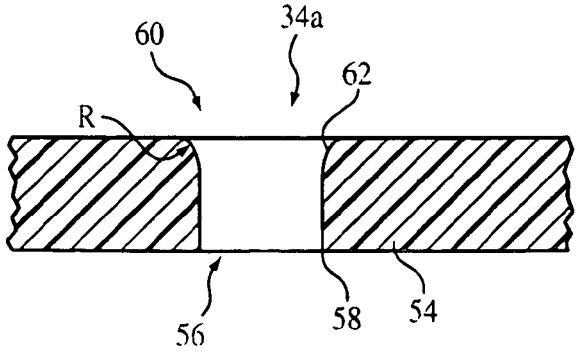
FIG. 7 is a cross-sectional view of a drinking hole in the spout.

FIG. 7, for example, shows a hole 34*a* that has an inner end 56, facing the cup side of the lid, with a sharp, square edge 58 about its circumference. On the other hand, its outer end 60, facing the spout recess, has a peripheral boundary 62 defined by a radius "R". Such a rounded exit edge may be formed, for example, by providing a radius about the base of a hole-molding pin pressed into a mold half forming the outer side of the membrane 54. Rounded edge 62 is thus likely to be free of any undesirable flash edges that could be reached by the tip of a child's tongue.

Figure 8:
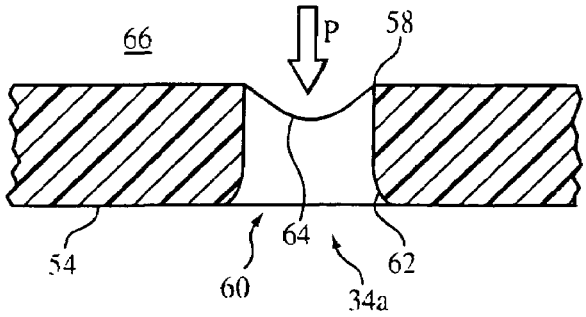
FIG. 8 illustrates flow through the hole being resisted by surface tension.

FIG. 8 illustrates the formation of a stable fluid bulge 64 extending into hole 34*a* from its inner end, under static pressure "P" applied by the weight of the liquid in the cup when the cup is inverted. A fluid membrane at the free surface of the bulge carries a surface tension that resists the rupture of the fluid membrane and the undesired leakage of the fluid through the hole. The level of pressure "P" that can be resisted by such surface tension will be a function of the relative surface energies of both the fluid 66 and the lid material at the interface between the edge of the bulge 64 and membrane 54 (at 58, for instance). Resistance to leakage will also depend on fluid viscosity and lateral hole dimensions. We have found that, for many liquids commonly consumed by small children, such as fruit juices, water and whole milk, circular holes 34*a* of a diameter less than about 0.025 inch (0.64 millimeter) acceptably resist leakage under a quasi-static head of about two inches of these liquids with no suction applied to the spout. Preferably, the lid should not leak more than 3 drops of liquid over a 10 second interval, with two vertical inches of liquid over the holes and no suction applied, after being gently rotated to an inverted position at a rate of about 180 degrees per second.

Figure 9:
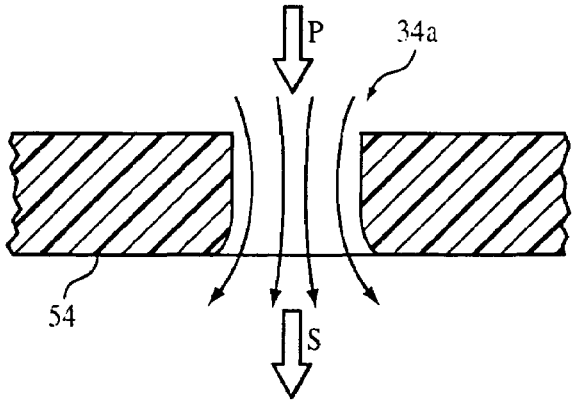
FIG. 9 illustrates flow enabled by the application of suction to the spout.

On the other hand, when a sub-atmospheric pressure "S" is applied to the outer end of the same hole as shown in FIG. 9, with the lid inverted, the maximum surface tension capacity of the bulge free surface will be exceeded and flow will commence. Once flow begins, it is likely to continue even if suction is removed. Because of this tendency, and because this lid contains no deformable or movable sealing surface to stop the flow when suction is removed, we recommend sizing holes 34*a* small enough that such flow will rarely be initiated without applied suction. Of course, conditions will arise that can cause undesirable flow initiation in the absence of suction, such as a child purposefully hammering on a hard surface with the spout of an inverted cup, but for many commercial applications the economic advantage of our approach can outweigh such concerns.

Figure 12A:
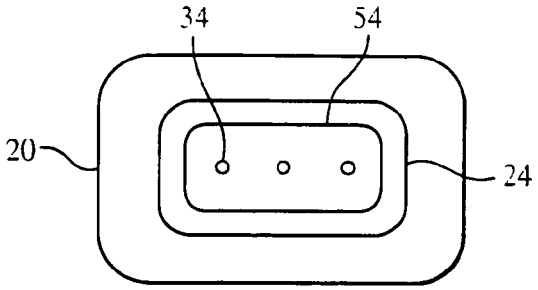
FIGS. 12A through 12E show various hole arrangements.
Figure 12B:
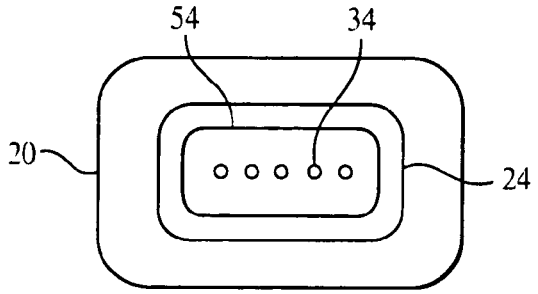
Figure 12C:
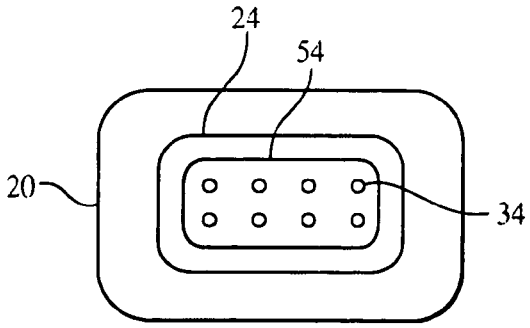
Figure 12D:
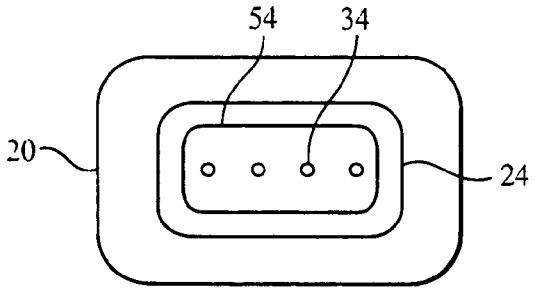
Figure 12E:
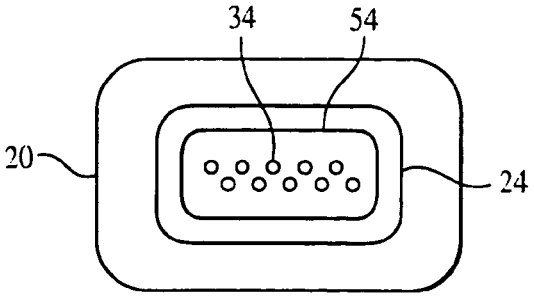

Given that each drinking hole of the spout is small enough to avoid leakage under normal non-suction conditions, an acceptable flow rate under drinking conditions is obtained by providing a sufficient number of holes. Preferably the holes will form an aggregate flow area, perpendicular of flow, sufficient to obtain a flow rate of at least 1.3 grams of liquid over a 10 second interval, with the cup inverted, about two vertical inches of liquid over the holes, and a steady vacuum equivalent to 8 inches of mercury (0.27 Bar) applied to the spout after inversion. Preferably, the aggregate flow area will be at least 0.35 square millimeter. In one present arrangement shown in FIG. 12A, the spout has a total of three separate holes, each with a diameter of about 0.017 inch, forming an aggregate flow area of about 0.44 square millimeter. In some other arrangements, shown in FIGS. 12B through 12E, other numbers of holes 34 are arranged in various patterns. FIGS. 12B and 12D, for example, show five and four holes 34, respectively, spaced apart along a line. FIGS. 12C and 12E, on the other hand, show eight and ten holes 34, respectively, arranged in two lines, with the holes 34 of FIG. 12E in a staggered arrangement. The larger the number of holes, the smaller each individual hole may be formed, to a practical limit, to decrease the propensity of leakage while maintaining an acceptable suction flow rate.

Referring back to FIG. 1, cup 10 is completely sealed with the exception of the drinking holes in spout 20. In other words, no vent allows air to flow into the cup as the liquid is dispensed. An air tight seal is maintained between the groove of lid 12 and the rim of cup body 14, such that a slightly sub-atmospheric pressure will develop within the cup body during drinking. As soon as drinking stops and the cup is uprighted, however, air will enter the cup through the drinking holes to eliminate any pressure difference. We find this to be acceptable for many applications, as children beyond nursing age do not typically maintain suction indefinitely while drinking. Furthermore, with disposable cup body 14 formed to have a particularly thin wall thickness, any substantial vacuum within the cup body will only tend to temporarily buckle the cup body wall if a child continues to build interior cup vacuum. In some other embodiments, the cup rim and lid groove are configured to allow some venting to occur.

Cup 10 is molded of high clarity, polypropylene random copolymer resin, such as Pro-fax SW-555M, preferably with an impact strength-enhancing modifier or additive, and has a particularly low weight and thickness that make the cup suitable for one-time use. For example, the cup body 14 shown in FIG. 1 has a nominal wall thickness of only about 0.025 inch (0.64 millimeter) and weighs, together with the lid, only about 15.5 grams. The material should meet FDA and other government standards for food-contact use. This particular material is also microwavable.

Furthermore, the design of the cup and lid make them individually nestable with other such cups and lids, such as for storing or retail packaging of multiple cups with multiple lids. Lid 14, however, may also be packaged and sold separately as a disposable lid for a non-disposable cup.

Figure 13:
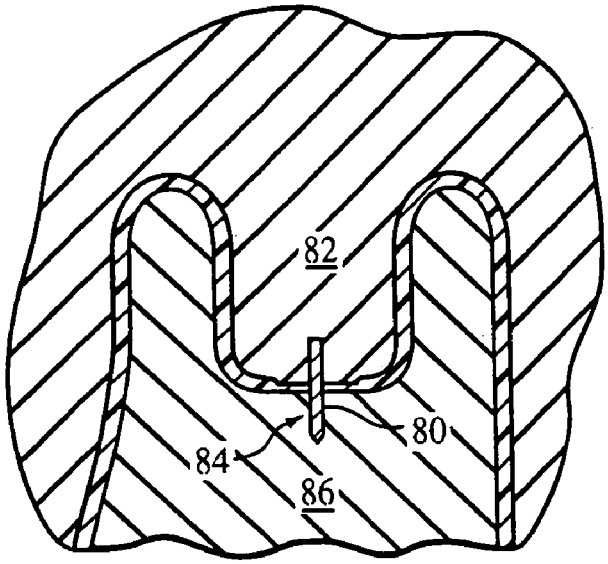
FIG. 13 is a cross-section through a mold for molding the upper end of the drinking spout and the holes.

The presently preferred method of forming the drinking holes in lid spout 20 is to form the holes as the spout itself is molded, rather than performing a post-molding operation to form the holes. Alternatively, the drinking holes may be formed by piercing or laser cutting, although these processing steps tend to add cost and can, in some cases, produce more variability in hole properties than molding. Referring to FIG. 13, we have found that these holes can be formed by a fixed pin 80 rigidly pressed into one of two opposing mold halves (e.g., into upper mold half 82) and either extending either into a corresponding hole 84 in the opposite mold half 86, as shown, or of a length selected to cause the distal end of the pin 80 to butt tightly up against the opposing mold surface to avoid molding flash that could seal off the intended hole.

Figure 10:
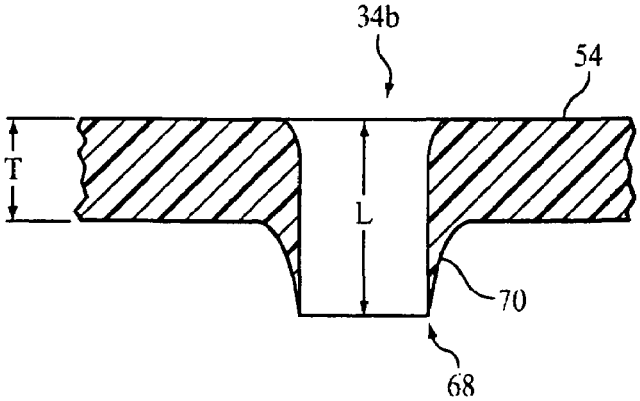
FIG. 10 shows a drinking hole with a raised lip.
Figure 10A:
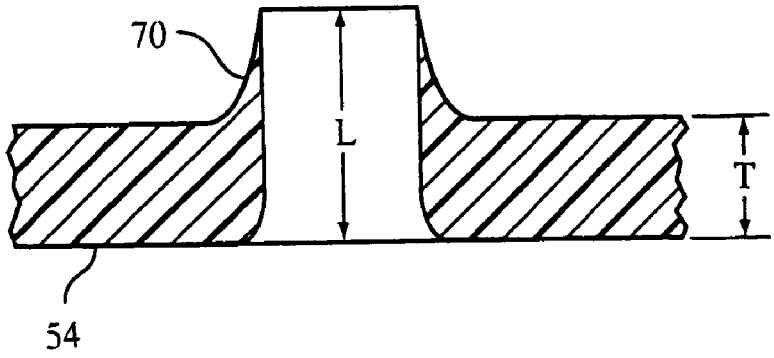
FIG. 10A shows an extension disposed on the other side of the membrane.

Many individual hole configurations are envisioned. Because the properties of the hole-defining surface where the edge of the stable liquid free surface forms (e.g., at the inner hole perimeter) are considered particularly important, we recommend maintaining close tolerances and strict quality controls, frequently replacing or repairing wearing mold surfaces that form these areas. For some applications, a curved inner hole edge will be preferred, such as by inverting the configuration of FIG. 7. In some cases a very sharp entrance edge 68 will be desired, such as may be produced at the distal end of a conical extension 70 surrounding a hole 34*b* on the inner surface of membrane 54, as shown in FIG. 10. Such a conical extension 70 is also useful for producing a longer axial hole length "L" than the nominal membrane thickness "T." If such an elongated hole is desired without a sharp entrance edge, the extension may be disposed on the other side of membrane 54, as shown in FIG. 10A. Extension 70 may be formed, for example, in a generous lead-in chamfer about a hole in a side of the mold forming the inner surface of membrane 54, that accepts a hole-forming pin rigidly secured to and extending from an opposite mold half.

Figure 11:
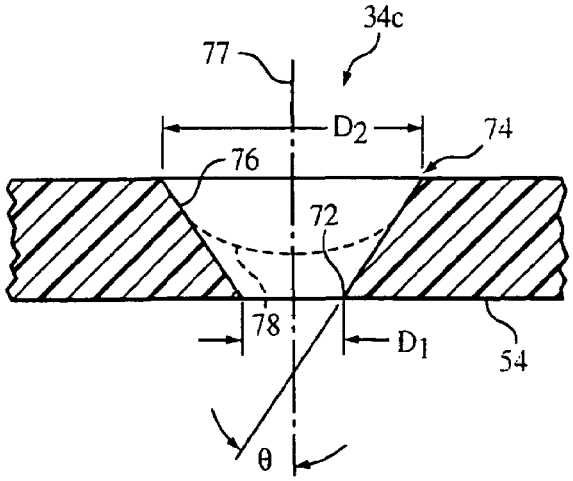
FIG. 11 shows a tapered hole.

As shown in FIG. 11, frustoconical holes 34*c* may also be employed. In the embodiment shown, at its outer edge 72 hole 34*c* has a diameter $D_1$ of about 0.017 inch (0.43 millimeter), while at its inner end 74 it has a diameter $D_2$ of about 0.061 inch (1.5 millimeter). With a nominal membrane thickness of about 0.029 inch (0.74 millimeter), hole side wall 76 is sloped at an angle θ, with respect to the hole axis 77, of about 37 degrees. It is believed that the inward slope of hole wall 76 aids in the development and support of a stable fluid meniscus 78, as shown in dashed outline. Tapered hole 34*c* may be formed by an appropriately tapered mold pin that either extends a distance into a corresponding recess in the opposite molding surface, or, with proper quality controls and tight tolerances, butt up against a flat opposite mold surface without any receiving recess, without significant flash concerns.

Although illustrated with respect to a child's sippy cup, aspects of the invention are also applicable to other drinking containers, such as sports bottles and the like. However, particular advantage is obtained in the context of a disposable sippy cup.

A number of embodiments of the invention have been described. Nevertheless, it will be understood that various modifications may be made without departing from the spirit and scope of the invention. Accordingly, other embodiments are within the scope of the following claims.

What is claimed is:

1. A drinking container comprising a main body defining an interior cavity accessible through an opening at an upper end of the main body; and a removable lid secured to the main body at its upper end to cover the opening and enclose, together with the main body, the interior cavity to hold a liquid;

the lid having an extended drinking spout sized to be received within a human mouth and defining multiple unrestricted holes providing open hydraulic communication between exterior surfaces of the container and the interior cavity, for dispensing liquid disposed proximate inner ends of the holes in response to a vacuum applied at outer ends of the holes;

the holes having a size selected to permit less than 3 drops of leakage of fresh water from the interior cavity through the holes over a 10 second interval under quasi-static conditions with a static head of 2.0 inches (51 millimeters) of fresh water at the inner ends of the holes and no vacuum applied to the spout with the container inverted, and to dispense an aggregate of at least 1.3 gram of fresh water from the spout over a 10 second interval with a static vacuum of 0.27 Bar below atmospheric pressure applied at the outer ends of the holes and a static head of 2.0 inches (51 millimeters) of fresh water at the inner ends of the holes with the container inverted.

2. The drinking container of claim 1 wherein the holes are defined through a membrane having a nominal thickness of between about 0.010 and 0.040 inch (0.25 and 1.0 millimeter) at the holes.

3. The drinking container of claim 2 wherein the membrane nominal thickness of the membrane is between about 0.015 and 0.030 inch (0.4 and 0.8 millimeter) at the holes.

4. The drinking container of claim 2 wherein the membrane comprises a semi-rigid material.

5. The drinking container of claim 1 wherein the holes are defined through a dimensionally stable membrane of the lid.

6. The drinking container of claim 5 wherein the membrane is generally planar and perpendicular to a longitudinal axis of each hole.

7. The drinking container of claim 5 wherein the membrane is recessed within the drinking spout.

8. The drinking container of claim 5 wherein the lid, including the membrane, is integrally and unitarily molded from a resin.

9. The drinking container of claim 8 wherein the lid has a nominal molded thickness of less than about 0.035 inch (0.90 millimeter).

10. The drinking container of claim 9 wherein the lid has a nominal molded thickness of between about 0.020 and 0.026 inch (0.51 and 0.66 millimeter).

11. The drinking container of claim 1 wherein the lid forms an air-tight seal with the main body at the upper end of the main body.

12. The drinking container of claim 1 wherein the lid has a main body portion defining a peripheral groove sized to receive an upper rim of the cup.

13. The drinking container of claim 12 comprising a snap ridge extending into the groove at an outer edge thereof and positioned to snap under a rim of the cup when the cup and lid are fully engaged.

14. The drinking container of claim 13 wherein the snap ridge is discontinuous about a periphery of the lid.

15. The drinking container of claim 1 wherein the holes each have a major lateral extent, perpendicular to a flow path along the hole, of less than about 0.025 inch (0.64 millimeter).

16. The drinking container of claim 15 wherein the major lateral extent of each hole is less than about 0.020 inch (0.51 millimeter).

17. The drinking container of claim 16 wherein the major lateral extent of each hole is less than about 0.014 inch (0.36 millimeter).

18. The drinking container of claim 1 wherein the drinking spout defines at least four said holes, with each hole having a diameter of less than about 0.012 inch (0.30 millimeter).

19. The drinking container of claim 1 wherein the drinking spout defines at least eight said holes.

20. The drinking container of claim 1 wherein the holes are defined by molded surfaces of the drinking spout.

21. The drinking container of claim 1 wherein the holes are flared at their inner ends.

22. The drinking container of claim 1 wherein the holes are defined through a membrane having a nominal thickness and forming a protruding lip about each hole, such that the holes each have a length greater than the nominal thickness of the membrane.

23. The drinking container of claim 22 wherein the lip extends toward the interior cavity.

24. The drinking container of claim 22 wherein the lip extends away from the interior cavity.

25. The drinking container of claim 22 wherein the lip tapers to a distal edge.

26. The drinking container of claim 1 wherein both the main body and the lid are each formed of molded resin of a nominal thickness of less than about 0.035 inch (0.89 millimeter).

27. The drinking container of claim 26 wherein the nominal thickness of both the main body and the lid is less than about 0.025 inch (0.64 millimeter).

28. The drinking container of claim 1 having an empty weight less than about 25 grams.

29. The drinking container of claim 28 having an empty weight less than about 18 grams.

30. The drinking container of claim 1 wherein the lid is formed of a resin containing polypropylene.

31. The drinking container of claim 1 wherein lid material defining the holes has a natural state surface energy of less than about 35 dynes per centimeter.

32. A drinking container comprising a main body defining an interior cavity accessible through an opening at an upper end of the main body; and a removable lid secured to the main body at its upper end to cover the opening and enclose, together with the main body, the interior cavity to hold a liquid;

the lid having an extended drinking spout sized to be received within a human mouth and defining multiple unrestricted holes providing open hydraulic communication between exterior surfaces of the container and the interior cavity, for dispensing liquid disposed proximate inner ends of the holes in response to a vacuum applied at outer ends of the holes;

the holes each having a major lateral extent, perpendicular to a flow path along the hole, of less than about 0.025 inch (0.64 millimeter), and forming an aggregate flow path through the spout of an area of at least 0.35 square millimeter.

33. The drinking container of claim 32 wherein the holes are of a size selected to cause fresh water in the interior cavity to form a stable meniscus at the holes under a static pressure head of 2.0 inches (51 millimeters) of fresh water, with the container inverted and atmospheric pressure applied to the outer ends of the holes.

34. The drinking container of claim 32 wherein the holes form an aggregate flow path through the spout of an area of at least 0.42 square millimeter.

35. The drinking container of claim 34 wherein the holes form an aggregate flow path through the spout of an area of at least 0.50 square millimeter.

36. The drinking container of claim 32 wherein the holes are defined through a membrane having a nominal thickness of between about 0.010 and 0.040 inch (0.25 and 1.0 millimeter) at the holes.

37. The drinking container of claim 36 wherein the membrane comprises a semi-rigid material.

38. The drinking container of claim 32 wherein the holes are defined through a dimensionally stable membrane of the lid.

39. The drinking container of claim 38 wherein the membrane is generally planar and perpendicular to a longitudinal axis of each hole.

40. The drinking container of claim 38 wherein the membrane is recessed within the drinking spout.

41. The drinking container of claim 38 wherein the lid, including the membrane, is integrally and unitarily molded from a resin.

42. The drinking container of claim 41 wherein the lid has a nominal molded thickness of less than about 0.035 inch (0.90 millimeter).

43. The drinking container of claim 32 wherein the lid forms an air-tight seal with the main body at the upper end of the main body.

44. The drinking container of claim 32 wherein the major lateral extent of each hole is less than about 0.020 inch (0.51 millimeter).

45. The drinking container of claim 44 wherein the major lateral extent of each hole is less than about 0.014 inch (0.36 millimeter).

46. The drinking container of claim 32 wherein the drinking spout defines at least four said holes.

47. The drinking container of claim 32 wherein the drinking spout defines at least eight said holes.

48. The drinking container of claim 32 wherein the holes are defined by molded surfaces of the drinking spout.

49. The drinking container of claim 32 wherein the holes are flared at their inner ends.

50. The drinking container of claim 32 wherein the holes are defined through a membrane having a nominal thickness and forming a protruding lip about each hole, such that the holes each have a length greater than the nominal thickness of the membrane.

51. The drinking container of claim 50 wherein the lip extends away from the interior cavity.

52. The drinking container of claim 50 wherein the lip tapers to a distal edge.

53. The drinking container of claim 32 wherein both the main body and the lid are each formed of molded resin of a nominal thickness of less than about 0.035 inch (0.89 millimeter).

54. The drinking container of claim 32 having an empty weight less than about 25 grams.

55. The drinking container of claim 32 wherein the lid is formed of a resin containing polypropylene.

56. The drinking container of claim 32 wherein lid material defining the holes has a natural state surface energy of less than about 35 dynes per centimeter.

57. A lid for a drinking container for children, the lid comprising a main body portion defining a peripheral groove sized to receive an upper rim of a cup to enclose a cavity for holding a liquid; and a drinking spout extending from the main body portion toward an outer side thereof and sized to be received within a human mouth, the spout defining multiple unrestricted holes providing open hydraulic communication between opposite sides of the lid, for dispensing liquid disposed proximate inner ends of the holes in response to a vacuum applied at outer ends of the holes;

the holes each having a major lateral extent, perpendicular to a flow path along the hole, of less than about 0.025 inch (0.64 millimeter), and forming an aggregate flow path through the spout of an area of at least 0.35 square millimeter.

58. The lid of claim 57 wherein the holes are of a size selected to cause fresh water at the inner ends of the holes to form a stable meniscus at the holes under a static pressure head of 2.0 inches (51 millimeters) of fresh water, with the lid inverted such that the spout extends downward and atmospheric pressure applied to the outer ends of the holes.

59. The lid of claim 57 wherein the holes are defined through a membrane having a nominal thickness of between about 0.010 and 0.040 inch (0.25 and 1.0 millimeter) at the holes.

60. The lid of claim 59 wherein the membrane comprises a semi-rigid material.

61. The lid of claim 57 wherein the holes are defined through a dimensionally stable membrane within the drinking spout.

62. The lid of claim 61 wherein the membrane is recessed at least 0.25 inch (6.5 millimeters) within the drinking spout, as measured from a distal end of the spout.

63. The lid of claim 61 wherein the membrane is generally planar and perpendicular to a longitudinal axis of each hole.

64. The lid of claim 61 wherein the lid, including the membrane, is integrally and unitarily molded from a resin.

65. The lid of claim 64 having a nominal molded thickness of less than about 0.035 inch (0.90 millimeter).

66. The lid of claim 65 having a nominal molded thickness of between about 0.020 and 0.026 inch (0.51 and 0.66 millimeter).

67. The lid of claim 57 having a solid surface across its extent, save for said holes.

68. The lid of claim 57 wherein the major lateral extent of each hole is less than about 0.020 inch (0.51 millimeter).

69. The lid of claim 68 wherein the major lateral extent of each hole is less than about 0.014 inch (0.36 millimeter).

70. The lid of claim 57 wherein the drinking spout defines exactly three said holes, with each hole having a minimum diameter of between about 0.016 and 0.025 inch (0.41 and 0.64 millimeter).

71. The lid of claim 57 wherein the drinking spout defines at least four said holes, with each hole having a diameter of less than about 0.020 inch (0.51 millimeter).

72. The lid of claim 57 wherein the drinking spout defines at least eight said holes.

73. The lid of claim 57 wherein the holes are defined by molded surfaces of the drinking spout.

74. The lid of claim 57 wherein the holes are flared at their inner ends.

75. The lid of claim 57 wherein the holes are defined through a membrane having a nominal thickness and forming a protruding lip about each hole, such that the holes each have a length greater than the nominal thickness of the membrane.

76. The lid of claim 57 wherein the holes are of frustoconical shape, with a larger end of each hole directed toward an inner side of the lid.

77. The lid of claim 57 formed of a resin containing polypropylene.

78. The lid of claim 57 wherein material defining the holes has a natural state surface energy of less than about 35 dynes per centimeter.

79. A method of preventing spills from drinking containers for children, the method comprising filling a cup with a consumable liquid; and securing a lid across an upper end of the cup, the lid comprising a main body portion defining a peripheral groove sized to receive an upper rim of a cup to enclose a cavity for holding a liquid; and a drinking spout extending from the main body portion toward an outer side thereof and sized to be received within a human mouth, the spout defining multiple unrestricted holes providing open hydraulic communication between opposite sides of the lid, for dispensing liquid disposed proximate inner ends of the holes in response to a vacuum applied at outer ends of the holes, the holes each having a major lateral extent, perpendicular to a flow path along the hole, of less than about 0.025 inch (0.64 millimeter), and forming an aggregate flow path through the spout of an area of at least 0.35 square millimeter.

* * * * *